US009742070B2

(12) United States Patent
Zhou et al.

(10) Patent No.: US 9,742,070 B2
(45) Date of Patent: Aug. 22, 2017

(54) OPEN END ANTENNA, ANTENNA ARRAY, AND RELATED SYSTEM AND METHOD

(71) Applicant: Samsung Electronics Co., LTD, Suwon-si, Gyeonggi-do (KR)

(72) Inventors: Hongyu Zhou, Richardson, TX (US); Farshid Aryanfar, Allen, TX (US)

(73) Assignee: Samsung Electronics Co., Ltd, Suwon-si, Gyeonggi-do (KR)

( * ) Notice: Subject to any disclaimer, the term of this patent is extended or adjusted under 35 U.S.C. 154(b) by 610 days.

(21) Appl. No.: 14/108,071

(22) Filed: Dec. 16, 2013

(65) Prior Publication Data

US 2014/0240186 A1 Aug. 28, 2014

Related U.S. Application Data

(60) Provisional application No. 61/770,837, filed on Feb. 28, 2013.

(51) Int. Cl.
*H01Q 13/06* (2006.01)
*H01Q 21/20* (2006.01)

(52) U.S. Cl.
CPC ..... *H01Q 13/06* (2013.01); *H01Q 21/205* (2013.01); *Y10T 29/49018* (2015.01)

(58) Field of Classification Search
CPC ..... H01Q 13/06
USPC ..... 343/772
See application file for complete search history.

(56) References Cited

U.S. PATENT DOCUMENTS 6,380,825 B1 * 4/2002 Takenoshita ..... H01P 1/02 333/125
7,808,439 B2 * 10/2010 Yang ..... H01P 3/121 343/770
8,692,731 B2 * 4/2014 Lee ..... H01Q 13/06 343/772
2006/0066487 A1 3/2006 Park et al.
2010/0308668 A1 12/2010 Rofougaran et al.
2011/0248891 A1 * 10/2011 Han ..... H01Q 1/40 343/700 MS
2011/0309899 A1 12/2011 Leiba et al.

OTHER PUBLICATIONS

U.S. Office Action dated Jul. 1, 2016 in connection with U.S. Appl. No. 14/176,941; 17 pages.

* cited by examiner

*Primary Examiner* — Dameon E Levi
*Assistant Examiner* — Walter Davis

(57) ABSTRACT

A system includes an antenna array and a transceiver configured to communicate wirelessly via the antenna array. The antenna array includes a substrate having first and second ground plates. The antenna array also includes multiple substrate integrated waveguide (SIW) antenna elements located along an edge of the substrate. The antenna array further includes feed lines configured to provide signals to the antenna elements and receive signals from the antenna elements. Each antenna element includes a waveguide between the first and second ground plates and enclosed by vias through the substrate, where the waveguide has one open edge along the edge of the substrate. The system could include multiple antenna arrays, where each antenna array includes multiple SIW antenna elements and the antenna arrays are located along different edges of the substrate.

23 Claims, 12 Drawing Sheets

RADIATION PATTERN 28GHz

OPEN END ANTENNA, ANTENNA ARRAY, AND RELATED SYSTEM AND METHOD

CROSS-REFERENCE TO RELATED APPLICATION AND PRIORITY CLAIM

This application claims priority under 35 U.S.C. §119(e) to U.S. Provisional Patent Application Ser. No. 61/770,837 filed on Feb. 28, 2013 and entitled "SIW OPEN END ANTENNA ON PCB EDGE." The above-identified patent document is hereby incorporated by reference in its entirety.

TECHNICAL FIELD

This disclosure relates generally to wireless communications. More specifically, this disclosure relates to an open end antenna, antenna array, and related systems and method.

BACKGROUND

In next-generation cellular communication systems, the use of millimeter-wave communications is highly likely due to the lack of available spectrum at lower frequencies. In these types of systems, in order to establish stable signal paths between user equipment and base stations, high-gain antenna arrays are likely to be mandatory in order to compensate for link losses and reduce power consumption at both ends. To minimize losses due to polarization mismatches between user equipment and base stations, circular polarization (CP) or dual linear polarization (LP) can be used in the base stations' antenna arrays.

In order to enable millimeter-wave cellular systems, phased antenna arrays may be employed at both base stations and user equipment to improve signal-to-noise ratios through beam forming. On the base station side, multiple planar antenna arrays capable of steering within specific sector areas could be used to cover a cell. On the user equipment side, the coverage requirement is often much more rigorous. Due to the unpredictable location and position of a base station with respect to the user equipment, the user equipment's antenna array may need to be able to steer its beam in any arbitrary direction and cover the entire space around the user equipment.

SUMMARY

In a first embodiment, an apparatus includes a substrate having first and second ground plates. The apparatus also includes a substrate integrated waveguide (SIW) antenna element located along an edge of the substrate. The apparatus further includes a feed line configured to provide signals to the antenna element and/or receive signals from the antenna element. The antenna element includes a waveguide between the first and second ground plates and enclosed by vias through the substrate, where the waveguide has one open edge along the edge of the substrate.

In a second embodiment, a system includes an antenna array and a transceiver configured to communicate wirelessly via the antenna array. The antenna array includes a substrate having first and second ground plates. The antenna array also includes multiple substrate integrated waveguide (SIW) antenna elements located along an edge of the substrate. The antenna array further includes feed lines configured to provide signals to the antenna elements and receive signals from the antenna elements. Each antenna element includes a waveguide between the first and second ground plates and enclosed by vias through the substrate, where the waveguide has one open edge along the edge of the substrate.

In a third embodiment, a method includes obtaining a substrate having first and second ground plates. The method also includes forming a substrate integrated waveguide (SIW) antenna element located along an edge of the substrate. The method further includes forming a feed line configured to provide signals to the antenna element and/or receive signals from the antenna element. Forming the antenna element includes forming a waveguide between the first and second ground plates and enclosed by vias through the substrate, where the waveguide has one open edge along the edge of the substrate.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system, or part thereof that controls at least one operation. A controller may be implemented in hardware or in a combination of hardware and firmware and/or software. It should be noted that the functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C. Definitions for certain other words and phrases are provided throughout this patent document, and those of ordinary skill in the art should understand that in many if not most instances, such definitions apply to prior as well as future uses of such defined words and phrases.

BRIEF DESCRIPTION OF THE DRAWINGS

For a more complete understanding of this disclosure, reference is now made to the following description, taken in conjunction with the accompanying drawings, in which.

DETAILED DESCRIPTION

FIGS. 1A through 10C, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

Figure 1A:
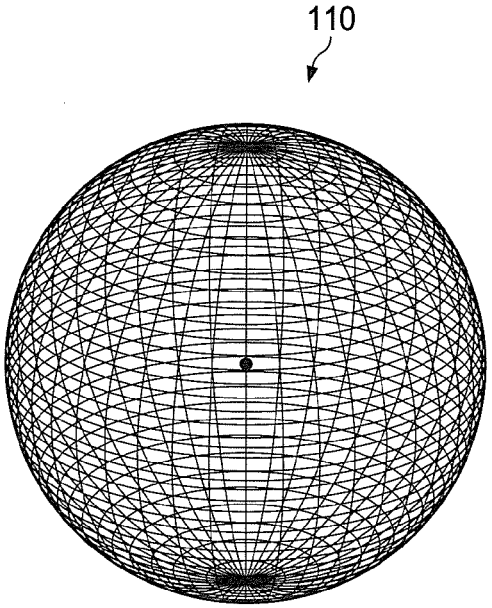
FIGS. 1A and 1B illustrate example radiation patterns generated by an ideal isotropic antenna element and a half-wavelength dipole.
Figure 1B:
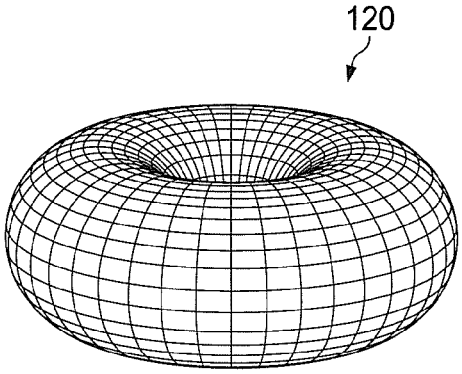

FIGS. 1A and 1B illustrate example radiation patterns 110-120 generated by an ideal isotropic antenna element and a half-wavelength dipole. Theoretically, a three-dimensional phased array with an isotropic radiation pattern 110 as shown in FIG. 1A would satisfy coverage requirements for millimeter-wave cellular systems. In reality, however, such an array does not exist. A close practical antenna element for such purposes is a half-wavelength dipole antenna, which exhibits an omni-directional radiation pattern 120 as shown in FIG. 1B. In a realistic implementation, the environment for a user equipment's antenna array includes the user equipment's chassis and other scattering elements, such as a liquid crystal display (LCD) or other display, a battery or other power supply, a printed circuit board (PCB) or other substrate, a power ground, and transceiver modules. These scattering elements can easily detune the radiation pattern of traditional widebeam/omni-directional antennas such as dipole antennas, making them directional.

This disclosure provides a more electrically-robust antenna element that can be easily mounted on or within a user equipment's chassis facing away from other components while providing a very wide radiation beam for improved space coverage. From an overall system standpoint, an antenna element ideally has a 180° beamwidth in one plane and a 90° beamwidth in another plane to cover a quarter of the surrounding space. In that case, user equipment would only use four antenna arrays with four groups of radio frequency (RF) transceiver chains to cover the entire environment. This type of antenna element and antenna array can also be used in various other types of devices, such as base stations.

Figure 2:
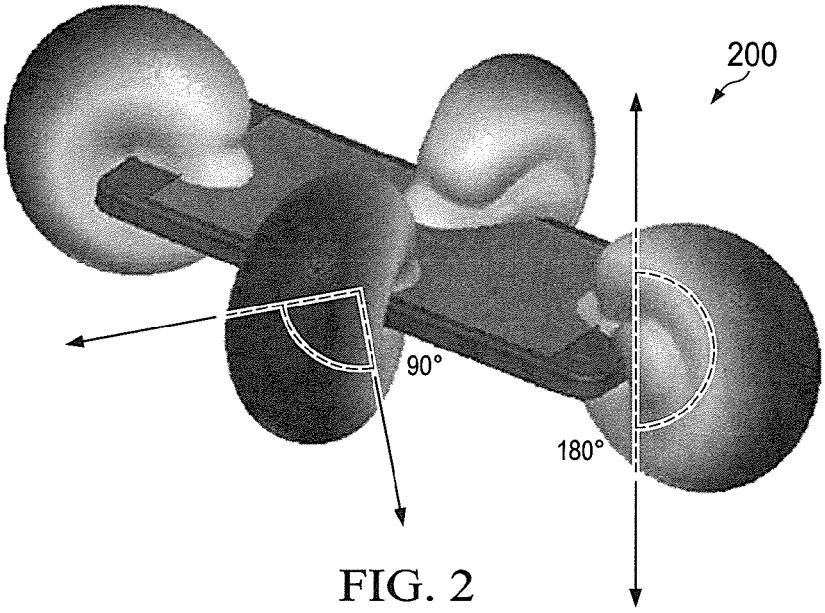
FIG. 2 illustrates an example antenna coverage from four antenna elements located in a user equipment (UE) or other device in accordance with this disclosure.

FIG. 2 illustrates an example antenna coverage 200 from four antenna elements located in a user equipment (UE) or other device in accordance with this disclosure. The antenna arrays here are located on different sides of the device, and each has an associated beam area in which wireless signals can be sent and/or received (referred to generally as "transceived"). The beam areas have sufficient gain for signal transception. The arrows define the desired beamwidths in each plane. Besides the beamwidth requirements, each antenna element can ideally be compatible with PCB processes and slim enough for array arrangement. Since the electrical thickness of a UE's PCB motherboard at millimeter-wave is approaching a quarter-wavelength in size, most conventional antenna elements become highly directive due to the high dielectric constant substrate underneath. This disclosure, however, provides antenna elements and antenna arrays that can satisfy these various requirements.

Figure 3:
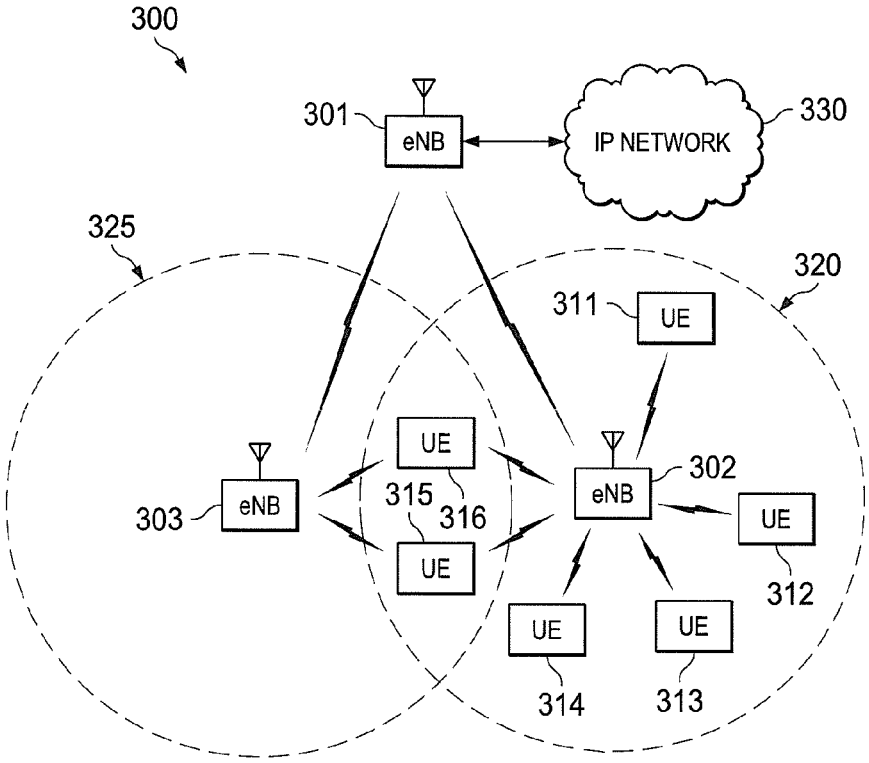
FIG. 3 illustrates an example wireless network according to this disclosure.

FIG. 3 illustrates an example wireless network 300 according to this disclosure. As shown in FIG. 3, the wireless network 300 includes an eNodeB (eNB) 301, an eNB 302, and an eNB 303. The eNB 301 communicates with the eNB 302 and the eNB 303. The eNB 301 also communicates with an Internet Protocol (IP) network 330, such as the Internet, a proprietary IP network, or other data network. The eNB 302 and the eNB 303 are able to access the network 330 via the eNB 301 in this example.

The eNB 302 provides wireless broadband access to the network 330 (via the eNB 301) to user equipment (UE) within a coverage area 320 of the eNB 302. The UEs here include UE 311, which may be located in a small business; UE 312, which may be located in an enterprise; UE 313, which may be located in a WiFi hotspot; UE 314, which may be located in a first residence; UE 315, which may be located in a second residence; and UE 316, which may be a mobile device (such as a cell phone, wireless laptop computer, or wireless personal digital assistant). Each of the UEs 311-316 may represent a mobile device or a stationary device. The eNB 303 provides wireless broadband access to the network 330 (via the eNB 301) to UEs within a coverage area 325 of the eNB 303. The UEs here include the UE 315 and the UE 316. In some embodiments, one or more of the eNBs 101-103 may communicate with each other and with the UEs 111-116 using LTE or LTE-A techniques.

Dotted lines show the approximate extents of the coverage areas 320 and 325, which are shown as approximately circular for illustration and explanation only. The coverage areas 320 and 325 may have other shapes, including irregular shapes, depending upon factors like the configurations of the eNBs and variations in radio environments associated with natural and man-made obstructions.

Depending on the network type, other well-known terms may be used instead of "eNodeB" or "eNB" for each of the components 301-303, such as "base station" or "access point." For the sake of convenience, the terms "eNodeB" and "eNB" are used here to refer to each of the network infrastructure components that provides wireless access to remote wireless equipment. Also, depending on the network type, other well-known terms may be used instead of "user equipment" or "UE" for each of the components 311-316, such as "mobile station" (MS), "subscriber station" (SS), "remote terminal" (RT), "wireless terminal" (WT), and "user device." For the sake of convenience, the terms "user equipment" and "UE" are used here to refer to remote wireless equipment that wirelessly accesses an eNB, whether the UE is a mobile device (such as a cell phone) or is normally considered a stationary device (such as a desktop computer or vending machine).

As described in more detail below, one or more eNBs 301-303 and/or one or more UEs 111-116 could each include at least one substrate integrated waveguide (SIW) antenna array. This type of antenna array can help to avoid various problems and shortcoming associated with conventional antenna array.

Although FIG. 3 illustrates one example of a wireless network 300, various changes may be made to FIG. 3. For example, the network 300 could include any number of eNBs and any number of UEs in any suitable arrangement. Also, the eNB 101 could communicate directly with any number of UEs and provide those UEs with wireless broadband access to the network 330. Further, the eNB 301 could provide access to other or additional external networks, such as an external telephone network. In addition, the makeup and arrangement of the wireless network 300 is for illustration only. The antenna arrays described below could be used in any other suitable device or system that engages in wireless communications.

Figure 4:
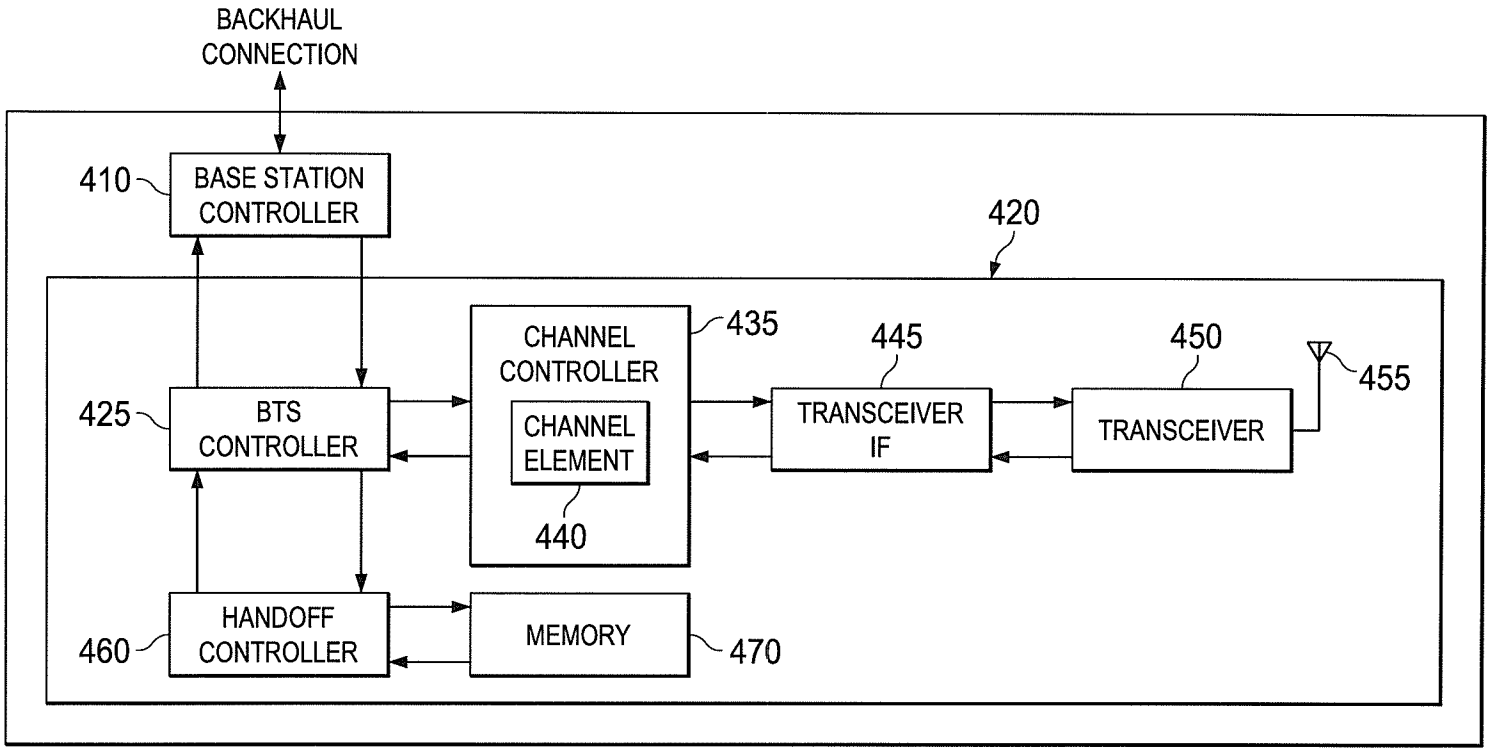
FIG. 4 illustrates an example eNodeB in accordance with this disclosure.

FIG. 4 illustrates an example eNodeB 301 in accordance with this disclosure. The same or similar structure could be used in the eNBs 302-303 of FIG. 3. As shown in FIG. 4, the eNB 301 includes a base station controller (BSC) 410 and one or more base transceiver subsystems (BTSs) 420. The BSC 410 manages the resources of the eNB 301, including the BTSs 420. Each BTS 420 includes a BTS controller 425, a channel controller 435, a transceiver interface (IF) 445, an RF transceiver 450, and an antenna array 455. The channel controller 435 includes a plurality of channel elements 440. Each BTS 420 may also include a handoff controller 460 and a memory 470, although these components could reside outside of a BTS 420.

The BTS controller 425 includes processing circuitry and memory capable of executing an operating program that communicates with the BSC 410 and controls the overall operation of the BTS 420. Under normal conditions, the BTS controller 425 directs the operation of the channel controller 435, where the channel elements 440 perform bi-directional communications in forward channels and reverse channels. The transceiver IF 445 transfers bi-directional channel signals between the channel controller 440 and the RF transceiver 450. The RF transceiver 450 (which could represent integrated or separate transmitter and receiver units) transmits and receives wireless signals via the antenna array 455. The antenna array 455 transmits forward channel signals from the RF transceiver 450 to UEs or other devices in the coverage area of the eNB 301. The antenna array 455 also sends to the transceiver 450 reverse channel signals received from the UEs or other devices in the coverage area of the eNB 301.

As described below, the antenna array 455 of the eNB 301 can include one or more SIW antenna arrays. Among other things, the antenna array 455 can support the use of millimeter-wave (MMW) antennas, including scanning antennas. Moreover, the antenna array 455 could be manufactured using standard PCB fabrication techniques.

Although FIG. 4 illustrates one example of an eNB 301, various changes may be made to FIG. 4. For example, various components in FIG. 4 could be combined, further subdivided, or omitted and additional components could be added according to particular needs. Also, while FIG. 4 illustrates the eNB 301 operating as a base station, eNBs could be configured to operate as other types of devices (such as an access point).

Figure 5:
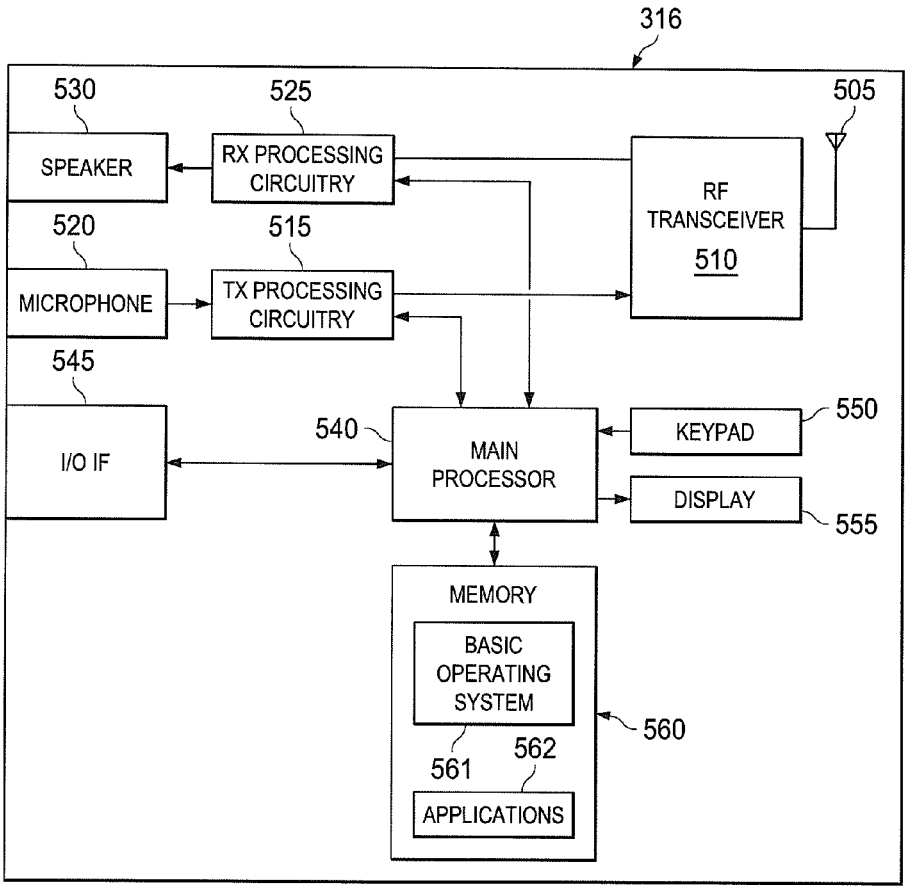
FIG. 5 illustrates an example user equipment (UE) in accordance with this disclosure.

FIG. 5 illustrates an example UE 316 in accordance with this disclosure. The same or similar structure could be used in the UEs 311-315 of FIG. 3. As shown in FIG. 5, the UE 316 includes an antenna array 505, an RF transceiver 510, transmit (TX) processing circuitry 515, a microphone 520, and receive (RX) processing circuitry 525. The UE 316 also includes a speaker 530, a main processor 540, an input/output (I/O) interface 545, a keypad 550, a display 555, and a memory 560. The memory 560 includes a basic operating system (OS) program 561 and one or more applications 562. The applications 562 can support various functions, such as voice communications, web browsing, productivity applications, and games.

The RF transceiver 510 receives, from the antenna array 505, an incoming RF signal transmitted by an eNB. The RF transceiver 510 down-converts the incoming RF signal to generate an intermediate frequency (IF) signal or a baseband signal. The IF or baseband signal is sent to the RX processing circuitry 525, which generates a processed baseband signal (such as by filtering, decoding, and/or digitizing the baseband or IF signal). The RX processing circuitry 525 can transmit the processed baseband signal to, for example, the speaker 530 (such as for voice data) or to the main processor 540 for further processing (such as for web browsing data).

The TX processing circuitry 515 receives analog or digital voice data from the microphone 520 or other outgoing baseband data (such as web, e-mail, or interactive video game data) from the main processor 540. The TX processing circuitry 515 encodes, multiplexes, and/or digitizes the outgoing baseband data to generate a processed baseband or IF signal. The RF transceiver 510 receives the outgoing processed baseband or IF signal from the TX processing circuitry 515 and up-converts the baseband or IF signal to an RF signal that is transmitted via the antenna array 505.

The main processor 540 executes the basic OS program 561 in order to control the overall operation of the UE 316. For example, the main processor 540 can control the reception of forward channel signals and the transmission of reverse channel signals by the RF transceiver 510, RX processing circuitry 525, and TX processing circuitry 515 in accordance with well-known principles.

The main processor 540 is also capable of executing other processes and programs, such as the applications 562. The main processor 540 can execute these applications 562 based on various inputs, such as input from the OS program 561, a user, or an eNB. In some embodiments, the main processor 540 is a microprocessor or microcontroller. The memory 560 can include any suitable storage device(s), such as a random access memory (RAM) and a Flash memory or other read-only memory (ROM).

The main processor 540 is coupled to the I/O interface 545. The I/O interface 545 provides the UE 316 with the ability to connect to other devices, such as laptop computers and handheld computers. The I/O interface 545 is the communication path between these accessories and the main processor 540. The main processor 540 is also coupled to the keypad 550 and the display unit 555. The operator of the UE 316 uses the keypad 550 to enter data into the UE 316. The display 555 may be a liquid crystal display capable of rendering text and/or at least limited graphics from web sites. Other embodiments may use other types of displays, such as touchscreen displays that can also receive user input.

As described below, the antenna array 505 of the UE 316 can include one or more SIW antenna arrays. Among other things, the antenna array 505 can support the use of MMW antennas, including scanning antennas. Moreover, the antenna array 505 could be manufactured using standard PCB fabrication techniques.

Although FIG. 5 illustrates one example of UE 316, various changes may be made to FIG. 5. For example, various components in FIG. 5 could be combined, further subdivided, or omitted and additional components could be added according to particular needs. Also, while FIG. 5 illustrates the UE 116 operating as a mobile telephone, UEs could be configured to operate as other types of mobile or stationary devices.

Figure 6A:
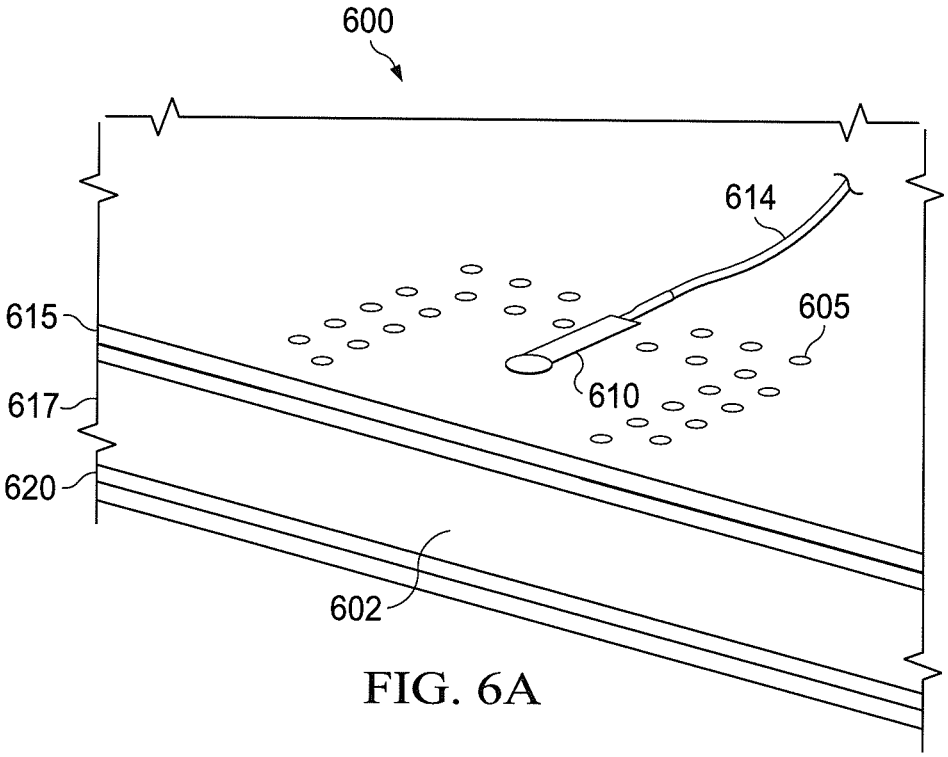
FIGS. 6A and 6B illustrate an example substrate integrated waveguide (SIW) antenna element in accordance with this disclosure.
Figure 6B:
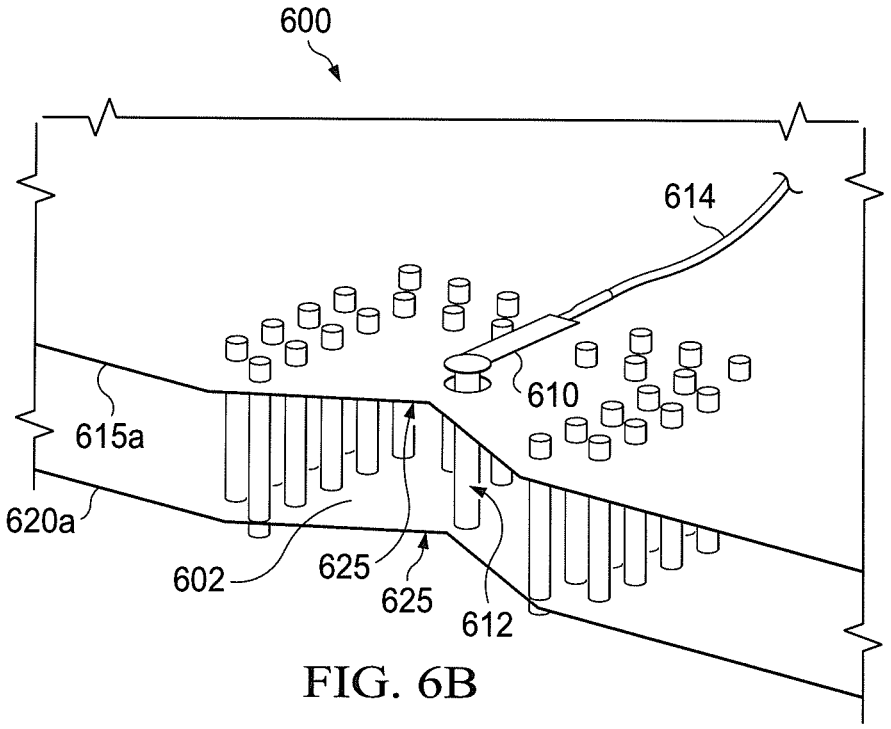

FIGS. 6A and 6B illustrate an example SIW antenna element 600 in accordance with this disclosure. More specifically, FIG. 6A illustrates the SIW antenna element 600 on a substrate, and FIG. 6B illustrates the same SIW antenna element 600 with the substrate hidden. The embodiment of the SIW antenna element 600 is for illustration only. Other embodiments could be used without departing from the scope of this disclosure.

As shown in FIGS. 6A and 6B, the SIW antenna element 600 is constructed on the edge of a multilayer PCB board and fed from a feed line 610 on a top PCB layer 615. The SIW antenna element 600 includes a waveguide 602 with an open end on the edge of the PCB board. Two ground plates 615*a* and 620*a* form top and bottom walls, respectively, of the open end waveguide 602. The ground plates 615*a*, 620*a* can be formed from any suitable material(s), such as one or more metals or other conductive material(s). The conductive plates can be formed in any suitable manner, such as by depositing and etching the conductive material(s) into the appropriate forms.

The sidewalls of the waveguide 602 are formed by multiple vias 605 that penetrate the ground plates 615*a*, 620*a* and enclose the waveguide 602 except for the open end. In this example, multiple lines of vias 605 are provided, and each line is substantially parallel to or substantially perpendicular to the edge of the substrate (thereby defining a rectangular waveguide, although this is not required). Moreover, the vias 605 form boundaries between adjacent antenna elements in an antenna array.

The vias 605 can be formed from the top PCB layer 615 down through a bottom PCB layer 620 and can be filled with any suitable material(s), such as by being plated with one or more conductive materials. As a result, the waveguide 602 is formed in a region between the top ground plate 615*a* and the bottom ground plate 620*a* within the area between the vias 605. A middle layer 617 between the top and bottom ground plates 615*a*, 620*a* can be filled with any suitable dielectric material(s). The open end waveguide 602 with the above geometry reinforces a standing wave mode of radiation.

A feed via 612 is also formed through the ground plates 615*a*, 620*a* and represents a transition between a microstrip mode and a waveguide mode. The feed via 612 therefore connects to the feed line 610 on the top PCB layer 615 and transfers a feed line signal down to the bottom ground plate 620*a*. Signals can also flow in the reverse direction from the ground plate 620*a* to the feed line 610 through the feed via 612.

In general, the physical depth of the feed via 612 is governed by the thickness of the substrate, which is often a very consistent number for a given PCB board. Due to the close proximity between the feed via 612 and the SIW opening, the feed via 612 functions properly with a fairly wide bandwidth. Note that the use of a feed via 612 is optional and that other structures could also be used. For instance, the antenna element 600 could include a feed pin suspended between the top and bottom waveguide walls.

In some embodiments, the feed line 610 can have a length that is equal to, for example, a half-wavelength or a quarter-wavelength of a communication frequency. However, this is not required, and the feed line 610 could have any other suitable length. The feed line 610 extends to a transmission line 614 that transports RF signals to or from a RF transceiver circuit. The transmission line 614 can be coupled to any suitable external device or system. The feed line 610 and the transmission line 614 can each be formed from any suitable conductive material(s) and in any suitable manner.

In some embodiments, the SIW antenna element 600 also includes notches 625 that are cut on the edges of the top and bottom ground plates 615*a*, 620*a* along the open edge of the waveguide 602. These notches 625 can be used to increase the antenna element's frequency stability, which can vary due to slight geometrical/electrical variations during manufacturing. While shown as having straight edges, each notch 625 could have any other suitable shape(s), such as an arc.

The various components forming the antenna element 600 in FIGS. 6A and 6B could be fabricated using standard PCB processing techniques or other standard techniques. This can help to reduce the cost and complexity of fabricating the antenna element 600 since standard processing operations can be used.

FIGS. 7A to 7D illustrate example simulated antenna performances of the antenna element 600 of FIGS. 6A and 6B with an edge tolerance in accordance with this disclosure. The simulation here is meant merely to illustrate one possible frequency sensitivity for the edge dimension tolerance of the antenna element 600 and does not limit the scope of this disclosure to any particular design having the same or similar performances. Other antenna performances could be obtained depending on the simulation conditions and the actual design of the antenna elements.

Figure 7A:
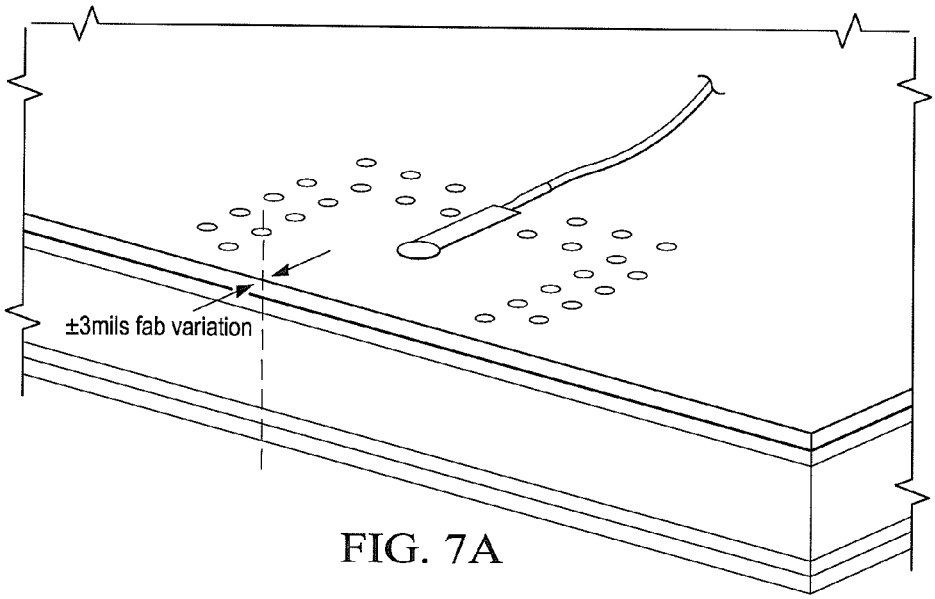
FIGS. 7A to 7D illustrate example simulated antenna performances of the antenna element of FIGS. 6A and 6B with an edge tolerance in accordance with this disclosure.

Standard PCB manufacturing processes often allow a ±3 mil edge-to-edge tolerance along an entire PCB as illustrated in FIG. 7A. Thus, antenna impedance performances are simulated here to study edge location sensitivity with a ±3 mil tolerance with respect to 50Ω.

Figure 7B:
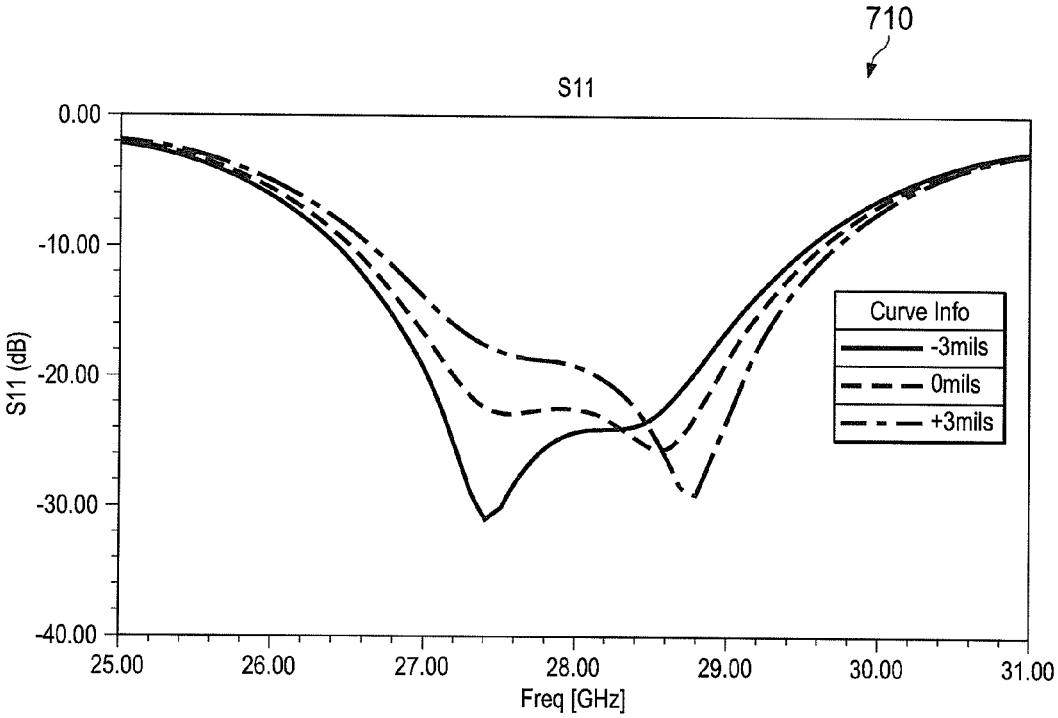
Figure 7C:
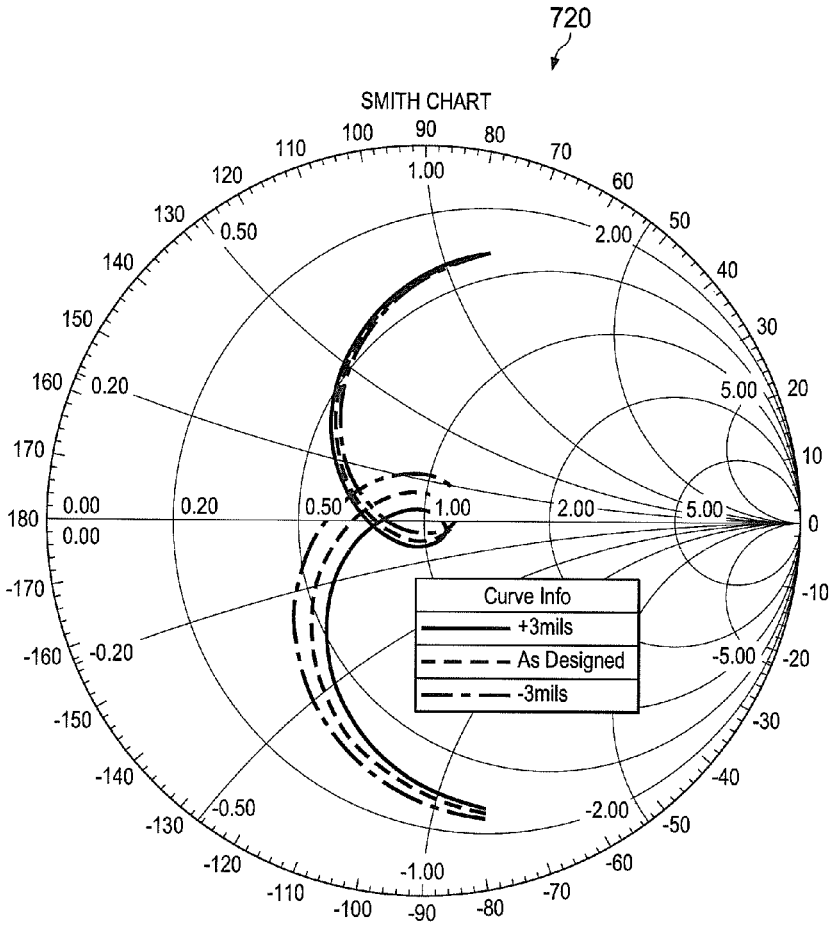
Figure 7D:
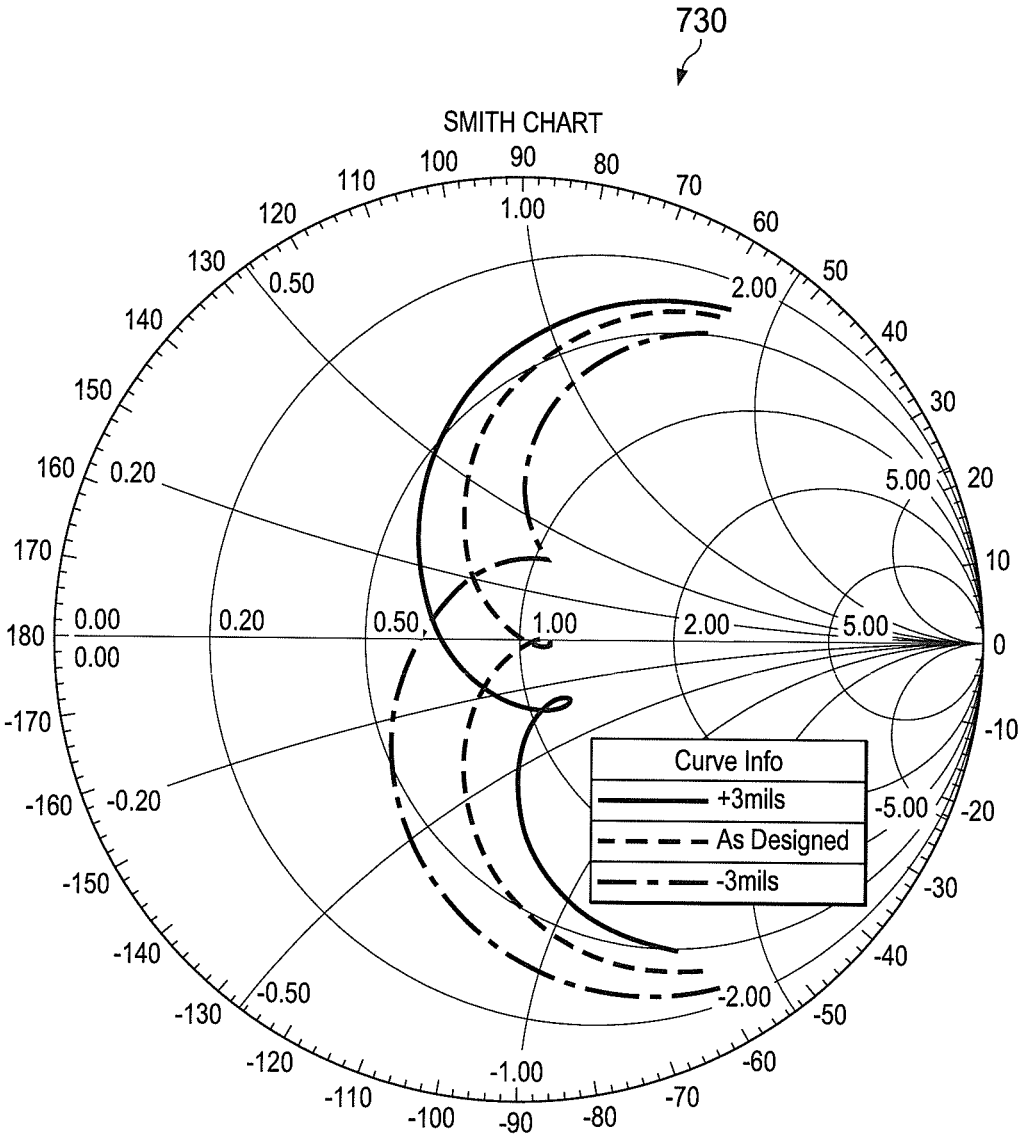

FIG. 7B depicts the simulated antenna impedance performances (S11) 710 with a ±3 mil edge tolerance. FIG. 7C depicts the simulated antenna impedance performances (S11) 720 on a Smith chart for the antenna element 600 with V-type notches 625, and FIG. 7D depicts simulated antenna impedance performances (S11) 730 on a Smith chart for the antenna element 600 without V-type notches 625. Comparing FIG. 7B and FIG. 7C, it is clear that the antenna impedance matching is insensitive to edge location changes within a ±3 mil margin when the V-type notches 625 are used. Without the V-type notches 625, the S11 variations are much more severe as shown in FIG. 7D.

Sensitivity studies have also been done for other parameters, such as substrate permittivity, thickness, and via location. The other parameters are typically less sensitive than the edge location. The embodiment here shows a 3 GHz bandwidth centered at 28 GHz (11%), which is adequate for proposed 5G cellular system operations.

Figure 8A:
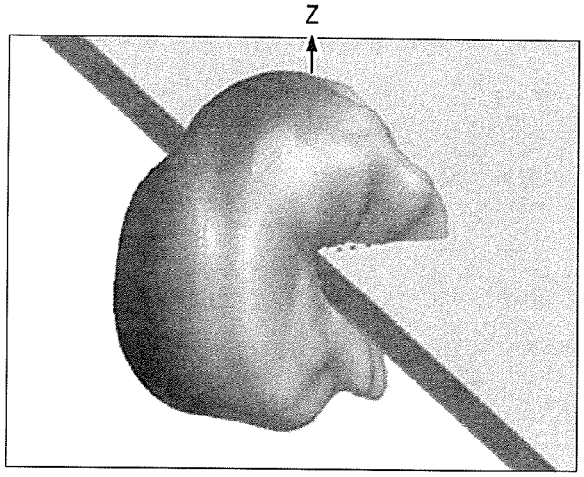
FIGS. 8A to 8C illustrate an example simulated 3 dB beamwidth in an E-plane and H-plane for the antenna element of FIGS. 6A and 6B in accordance with this disclosure.
Figure 8B:
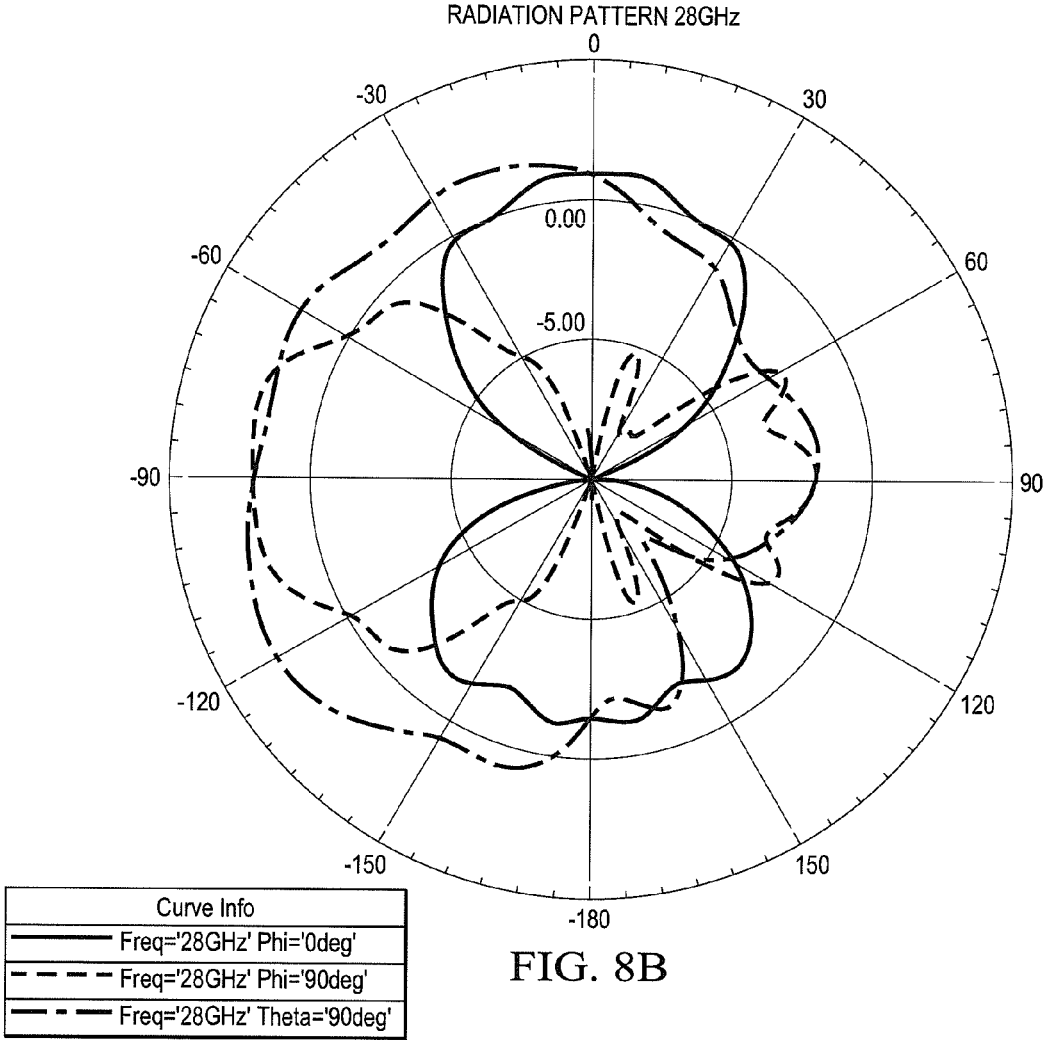
Figure 8C:
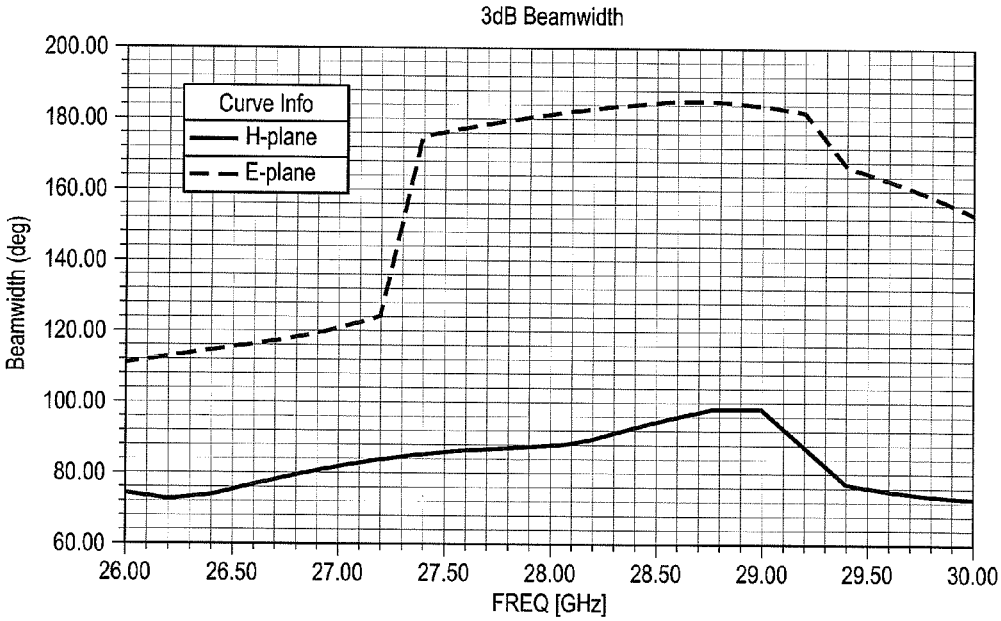

FIGS. 8A to 8C illustrate an example simulated 3 dB beamwidth in an E-plane and H-plane for the antenna element 600 of FIGS. 6A and 6B in accordance with this disclosure. The simulation here does not limit the scope of this disclosure to any particular design having the same or similar characteristics. Other antenna characteristics could be obtained depending on the simulation conditions and the actual design of the antenna elements.

This implementation of the antenna element 600 features an ultra-wide beam in the E-plane (Φ=90°), which is around 180° from 27.4 GHz to 29.2 GHz. This embodiment also has a relatively wide H-plane around 90° for the same frequency band. The wide-beam characteristics help to ensure that the antenna element 600 covers a large space region, allowing for a reduced or minimum number of antenna arrays to cover an entire space. This specific embodiment can cover an entire space with one array located on each edge of a PCB board.

Figure 9A:
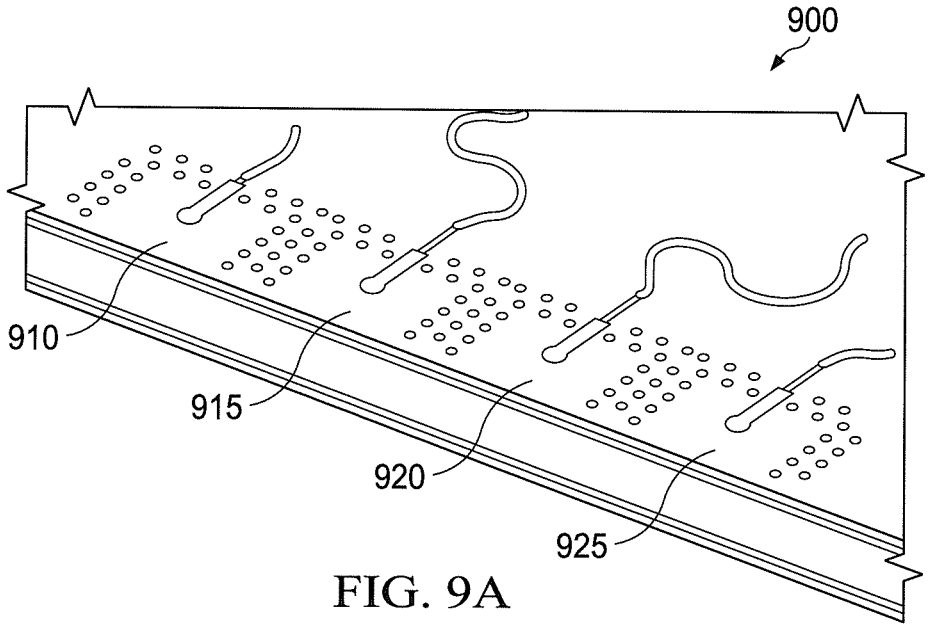
FIGS. 9A and 9B illustrate an example antenna array in accordance with this disclosure.
Figure 9B:
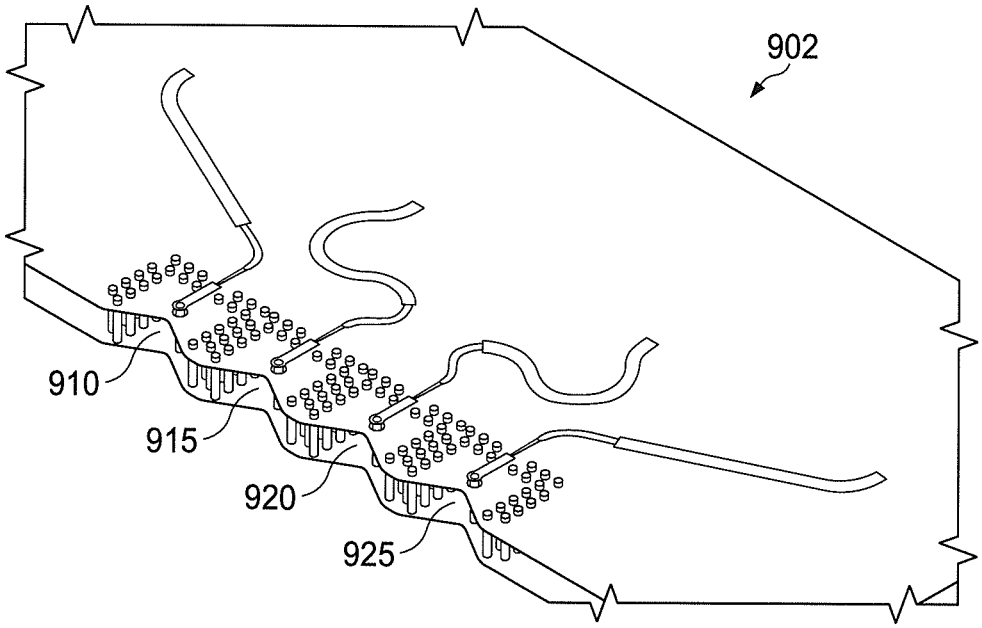

FIGS. 9A and 9B illustrate an example antenna array 900 in accordance with this disclosure. More specifically, FIG. 9A illustrates the antenna array 900 on a substrate, and FIG. 9B illustrates the same antenna array 900 with the substrate hidden. The embodiment of the antenna array 900 is for illustration only. Other embodiments could be used without departing from the scope of this disclosure.

As shown in FIGS. 9A and 9B, the antenna array 900 includes four SIW antenna elements 910-925, which are arranged in a line along one edge of a substrate to form a four-by-one linear antenna array. However, it is noted that the antenna array 900 could include any suitable number of SIW antenna elements. Each SIW antenna element 910-925 could represent the antenna element 600 of FIGS. 6A and 6B.

As described with reference to FIGS. 6A and 6B, each SIW antenna element 910-925 includes a waveguide with an open end, a feed via, and a feed line. Each waveguide is formed between top and bottom ground plates and is enclosed by the vias, except for the open end. A feed via can be fed through the top and bottom ground plates, and each SIW antenna element 910-925 could have notches cut into the top and bottom ground plates. Feed lines of the SIW antenna elements 910-925 can be connected to common or separate RF circuits.

Each component of the antenna array 900 could be formed using any suitable material(s), and the antenna array 900 could be fabricated in any suitable manner. For example, holes can be formed in a substrate (such as a PCB) and filled to form conductive vias, and conductive material(s) can be deposited on the substrate and etched to form other structures of the antenna array 900. The antenna array 900 could also be used in any suitable devices or systems, including the eNBs 301-303 and UEs 311-316 of FIGS. 3 through 5.

Figure 10A:
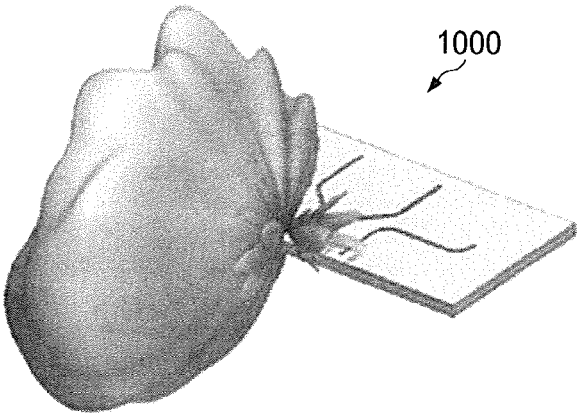
FIGS. 10A to 10C illustrate example simulated radiation patterns when the antenna array of FIGS. 9A and 9B is scanned from −45° to +45° in accordance with this disclosure.
Figure 10B:
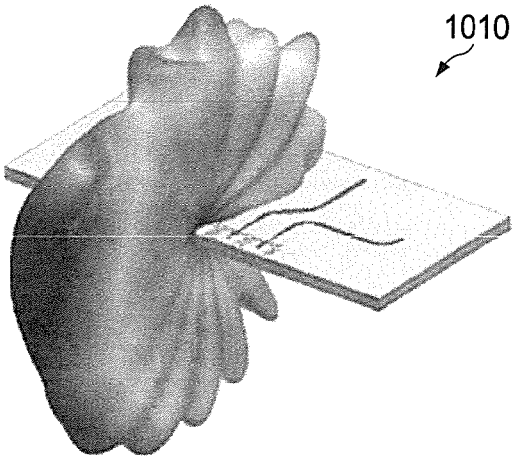
Figure 10C:
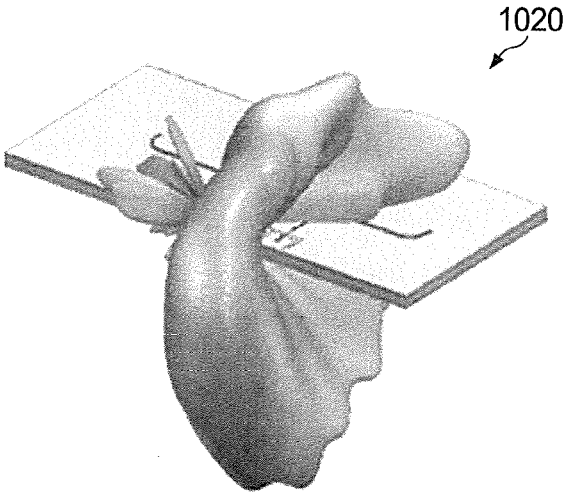

FIGS. 10A to 10C illustrate example simulated radiation patterns when the antenna array 900 of FIGS. 9A and 9B is scanned from −45° to +45° in accordance with this disclosure. The simulation here is meant merely to illustrate possible radiation patterns of the antenna array 900 and does not limit the scope of this disclosure to any particular design having the same or similar radiation patterns. Other radiation patterns could be obtained depending on the simulation conditions and the actual design of the antenna array.

As shown in FIG. 10A, the leftmost antenna element 910 is scanned to −45° to generate the simulated radiation pattern 1000. The two middle antenna elements 915-920 are scanned to 0° as shown in FIG. 10B to generate the simulated radiation pattern 1010. As shown in FIG. 10C, the rightmost antenna element 925 is scanned to +45° to generate the simulated radiation pattern 1020. As expected, the SIW antenna array 900 covers a quarter of the space with at least 5 dBi gain.

The SIW antenna array 900 features low-profile and wide-beam properties that can be highly suitable for phased arrays in advanced wireless communication devices, such as 4G or 5G user equipment. The antenna array's geometry is compatible with standard PCB processes, and the antenna array's performance exhibits high tolerance with respect to slight fabrication variations, which helps to guarantee low cost and high yield during mass production.

Although FIGS. 6A to 10C illustrate an SIW antenna element, an SIW antenna array, and related details, various changes may be made to FIGS. 6A through 10C. For example, while particular implementations of an antenna array using certain numbers of SIW antenna elements are shown, the types, number, and arrangement of the antenna elements are for illustration only. Also, figures showing radiation patterns and other potential operations or characteristics of an antenna element or antenna array are non-limiting. These figures are merely meant to illustrate possible functional aspects of specific embodiments of this disclosure. These figures are not meant to imply that all inventive devices operate in the specific manner shown in those figures.

None of the description in this application should be read as implying that any particular element, step, or function is an essential element that must be included in the claim scope: the scope of patented subject matter is defined only by the claims. Moreover, none of these claims is intended to invoke paragraph six of 35 USC §112 unless the exact words "means for" are followed by a participle.

What is claimed is:

1. An apparatus comprising:

a substrate comprising first and second ground plates;

a substrate integrated waveguide (SIW) antenna element located along an edge of the substrate;

a feed line configured to at least one of: provide signals to the antenna element and receive signals from the antenna element; and a feed via connected to the feed line, wherein the feed via is configured to transfer a signal from the feed line to a bottom one of the first and second ground plates, wherein the antenna element comprises a waveguide between the first and second ground plates that is enclosed by vias through the substrate, the waveguide including one open edge along the edge of the substrate, and wherein sidewalls of the waveguide are formed by multiple lines of the vias that penetrate the first and second ground plates and enclose the waveguide except for the one open edge.

2. The apparatus of claim 1, wherein the apparatus comprises an antenna array, the antenna array comprising multiple SIW antenna elements located along the edge of the substrate.

3. The apparatus of claim 2, wherein the apparatus comprises multiple antenna arrays, each of the antenna arrays comprising multiple SIW antenna elements, the antenna arrays located along different edges of the substrate.

4. The apparatus of claim 1, wherein the feed via extends through the first and second ground plates.

5. The apparatus of claim 1, wherein the vias are arranged in the multiple lines including lines substantially parallel to the edge of the substrate and lines substantially perpendicular to the edge of the substrate.

6. The apparatus of claim 1, wherein each of the first and second ground plates has a notch along the edge of the substrate.

7. The apparatus of claim 6, wherein the notch has a shape of "V" in a middle of the waveguide.

8. The apparatus of claim 1, wherein:

the substrate further comprises a top layer, a middle layer, and a bottom layer;

the first ground plate is located between the top and middle layers;

the second ground plate is located between the bottom and middle layers; and the feed line is located on a surface the top layer.

9. A system comprising:

an antenna array; and a transceiver configured to communicate wirelessly via the antenna array;

wherein the antenna array comprises:

a substrate comprising first and second ground plates;

multiple substrate integrated waveguide (SIW) antenna elements located along an edge of the substrate;

feed lines configured to provide signals to the antenna elements and receive signals from the antenna elements; and feed vias connected to each of the feed lines, respectively, wherein the feed vias are configured to transfer signals from the feed lines, respectively, to a bottom one of the first and second ground plates, wherein each of the antenna elements comprises a waveguide between the first and second ground plates that is enclosed by vias through the substrate, the waveguide including one open edge along the edge of the substrate, and wherein sidewalls of each waveguide are formed by multiple lines of the vias that penetrate the first and second ground plates and enclose the waveguide except for the one open edge.

10. The system of claim 9, wherein the system comprises multiple antenna arrays, each of the antenna arrays comprising a plurality of the multiple SIW antenna elements, the antenna arrays located along different edges of the substrate.

11. The system of claim 9, wherein the feed vias extend through the first and second ground plates.

12. The system of claim 9, wherein the vias in each of the antenna elements are arranged in the multiple lines including lines substantially parallel to the edge of the substrate and lines substantially perpendicular to the edge of the substrate.

13. The system of claim 9, wherein each of the first and second ground plates has a notch along the edge of the substrate.

14. The system of claim 13, wherein the notch has a shape of "V" in a middle of the waveguide.

15. The system of claim 9, wherein:

the substrate further comprises a top layer, a middle layer, and a bottom layer;

the first ground plate is located between the top and middle layers;

the second ground plate is located between the bottom and middle layers; and the feed lines are located on a surface the top layer.

16. The system of claim 15, wherein the middle layer comprises a dielectric layer.

17. The system of claim 9, wherein the system comprises an eNodeB.

18. The system of claim 9, wherein the system comprises a user equipment.

19. The system of claim 9, wherein at least some of the vias in each of the antenna elements form a boundary with at least one adjacent antenna element.

20. The system of claim 9, wherein:

the antenna array comprises four linearly-arranged SIW antenna elements; and the transceiver is configured to scan one outer SIW antenna element to −45°, two middle SIW antenna elements to 0°, and another outer SIW antenna element to +45°.

21. A method comprising:

obtaining a substrate comprising first and second ground plates;

forming a substrate integrated waveguide (SIW) antenna element located along an edge of the substrate; and forming a feed line configured to at least one of: provide signals to the antenna element and receive signals from the antenna element;

wherein the feed line is connected to a feed via and the feed via is configured to transfer a signal from the feed line to a bottom one of the first and second ground plates, wherein forming the antenna element comprises forming a waveguide between the first and second ground plates that is enclosed by vias through the substrate, the waveguide including one open edge along the edge of the substrate, and wherein sidewalls of the waveguide are formed by multiple lines of the vias that penetrate the first and second ground plates and enclose the waveguide except for the one open edge.

22. The method of claim 21, further comprising:

forming multiple antenna arrays, each antenna array comprising multiple SIW antenna elements, the antenna arrays located along different edges of the substrate.

23. The method of claim 21, wherein each of the first and second ground plates has a notch along the edge of the substrate, the notch having shape of "V" in a middle of the waveguide.

* * * * *